US009556546B2

(12) United States Patent
Kawaguchi et al.

(10) Patent No.: US 9,556,546 B2
(45) Date of Patent: Jan. 31, 2017

(54) SEWING MACHINE

(71) Applicant: BROTHER KOGYO KABUSHIKI KAISHA, Nagoya-shi, Aichi-ken (JP)

(72) Inventors: Yasuhiko Kawaguchi, Nagoya (JP); Nobuhiko Funato, Gifu (JP); Toshiyuki Mamiya, Kasugai (JP); Takahira Osamura, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 43 days.

(21) Appl. No.: 14/604,053

(22) Filed: Jan. 23, 2015

(65) Prior Publication Data

US 2015/0225883 A1 Aug. 13, 2015

(30) Foreign Application Priority Data

Feb. 10, 2014 (JP) ..... 2014-023235

(51) Int. Cl.
*D05B 19/12* (2006.01)
*D05B 81/00* (2006.01)

(52) U.S. Cl.
CPC ..... *D05B 19/12* (2013.01); *D05B 81/00* (2013.01)

(58) Field of Classification Search
CPC ..... D05B 37/00; D05B 37/04; D05B 37/06; D05B 37/063; D05B 81/00; D05B 19/12; D05B 19/14; D05B 37/08; D05C 9/06
See application file for complete search history.

(56) References Cited

U.S. PATENT DOCUMENTS 4,649,841 A * 3/1987 Koshinaka ..... D05B 1/20 112/129
4,773,342 A * 9/1988 Fietta ..... D05B 37/04 112/122

(Continued)

FOREIGN PATENT DOCUMENTS

JP H05-76672 A 3/1993
JP H05-76673 A 3/1993

(Continued)

OTHER PUBLICATIONS

U.S. Appl. No. 14/589,522, filed Jan. 5, 2015 in the name of Kawaguchi et al.

*Primary Examiner* — Danny Worrell
*Assistant Examiner* — Megan Brandon
(74) *Attorney, Agent, or Firm* — Oliff PLC

(57) ABSTRACT

A sewing machine includes a sewing machine motor configured to generate drive power to drive a needle bar up-and-down motion mechanism and a cutting unit. The cutting unit includes a cutting needle having a distal end with a blade, and a cutting needle up-and-down motion mechanism having a first motor separate from a sewing machine motor and configured to generate drive power to move the cutting needle independently of the needle bar up-and-down motion mechanism. A cut is formed by the blade as a result of up-and-down motion of the cutting needle while the cutting needle is held in a manner such that an extending direction of the cutting needle corresponds with an extending direction of the needle bar. The cutting unit further includes a cutting needle rotating mechanism configured to rotate the cutting needle about a central axis line of the cutting needle directed to the extending direction.

13 Claims, 10 Drawing Sheets

(56) References Cited

U.S. PATENT DOCUMENTS 4,984,525 A * 1/1991 Mori ..... D05B 37/063 112/128
5,129,338 A * 7/1992 Wang ..... D05B 37/04 112/126
5,778,806 A * 7/1998 Badillo ..... D05B 3/06 112/475.25
5,813,356 A * 9/1998 Nolle ..... D05B 37/06 112/122
6,082,279 A * 7/2000 Ito ..... D05B 27/24 112/314
6,101,960 A * 8/2000 Ebata ..... D05B 37/063 112/122
6,289,943 B1 * 9/2001 Engle ..... D05B 1/20 112/122
6,523,488 B1 * 2/2003 Lee ..... D06H 7/02 112/128
8,161,896 B1 * 4/2012 Ingram ..... D05B 85/00 112/80.05
2002/0195035 A1 * 12/2002 Sadasue ..... D05B 37/06 112/129
2005/0087111 A1 * 4/2005 Chang ..... D05B 37/06 112/129
2009/0205549 A1 * 8/2009 Hirose ..... D05B 19/16 112/470.04
2009/0235854 A1 * 9/2009 Heinrich ..... D05C 7/08 112/99
2010/0050915 A1 * 3/2010 Konig ..... D05C 7/04 112/89
2010/0199900 A1 * 8/2010 Brunner ..... D05C 13/00 112/270
2011/0168070 A1 * 7/2011 Lanquist ..... D05B 19/10 112/475.19
2013/0112129 A1 * 5/2013 Muto ..... D05B 81/00 112/470.05
2013/0152838 A1 * 6/2013 Matsumoto ..... D05B 65/02 112/285
2013/0199430 A1 * 8/2013 Kato ..... D05B 81/00 112/470.05
2013/0333603 A1 * 12/2013 Sugawara ..... D05B 37/06 112/128
2014/0060408 A1 * 3/2014 Okuyama ..... D05B 37/04 112/470.05
2014/0261122 A1 * 9/2014 Tseng ..... D05B 37/063 112/291
2014/0290547 A1 * 10/2014 Hasegawa ..... D05B 19/14 112/102.5
2014/0290550 A1 * 10/2014 Hasegawa ..... D05B 19/12 112/470.05

FOREIGN PATENT DOCUMENTS

JP H06-81263 A 3/1994
JP H06-262419 A 9/1994
JP 2005-124780 A 5/2005
JP 2006-291407 A 10/2006
JP 2009-011633 A 1/2009
JP 2010-099118 A 5/2010

* cited by examiner

SEWING MACHINE

CROSS-REFERENCE TO RELATED APPLICATIONS

This application is based upon and claims the benefit of priority from the prior Japanese Patent Application No. 2014-023235 filed on Feb. 10, 2014, the entire contents of which are incorporated herein by reference.

BACKGROUND

1. Technical Field

The present disclosure relates to a sewing machine including a needle bar to which a needle is attached and a needle-bar up-and-down motion mechanism moving the needle bar up and down.

2. Related Art

A sewing machine such as a chain stitch sewing machine has conventionally been known which includes a needle-bar up-and-down motion mechanism and a looper. The needle-bar up-and-down motion mechanism moves up and down a needle bar to which a crochet needle is attached. The looper forms loop stitches in cooperation with the crochet needle. The above-described type of sewing machine includes a cutting device which is diverted to include a cutting needle protruding from a lower part of the needle bar, instead of the crochet needle and which cuts a workpiece cloth by the cutting needle.

More specifically, the chain stitch sewing machine has a head provided with a needle-bar rotating mechanism which rotates the needle bar about a central axis line of the needle bar. When the workpiece cloth is fed horizontally, the needle-bar rotating mechanism rotates the needle bar so that a blade edge of the cutting needle is oriented to a feed direction of the workpiece cloth. As a result, the chain stitch sewing machine moves the needle bar up and down to cause the blade edge oriented as described above to penetrate the workpiece cloth, thereby forming a cut. The chain stitch sewing machine repeats rotation and up-and-down motion of the needle bar while feeding the workpiece cloth to continuously form cuts in the workpiece cloth, thereby forming a desired shape. Thus, the chain stitch sewing machine can be diverted to a cutting machine which cuts out the workpiece cloth without changes in the basic construction to a large extent.

SUMMARY

On the other hand, cutwork has widely become popular in which a part of workpiece cloth is cut away and the cut part is filled with an embroidery pattern for addition of ornamentation.

In this regard, when the chain stitch sewing machine is diverted to the cutting device as described above, a part of the workpiece cloth can be cut away so as to have a predetermined configuration. However, a sewing machine which is separate from the chain stitch sewing machine and is capable of sewing an embroidery pattern is required in order that the cut part of the workpiece cloth may be filled with an embroidery pattern. In this case, furthermore, the sewing machine capable of sewing an embroidery pattern requires a position adjustment to match a sewing location to the cut position of the workpiece cloth, with the result that the position adjustment is complex and troublesome. Moreover, since the position adjustment of the workpiece cloth is manually carried out, accurate positioning is difficult.

Therefore, an object of the disclosure is to provide a sewing machine which can carry out both cutting and sewing of the workpiece cloth without trouble and can accurately match the sewing location to the cut position of the workpiece cloth.

The disclosure provides a sewing machine including a needle bar to which a sewing needle is attached and a needle bar up-and-down motion mechanism moving the needle bar up and down. The sewing machine further includes a sewing machine motor configured to generate drive power to drive the needle bar up-and-down motion mechanism so that the needle bar is moved up and down, and a cutting unit. The cutting unit includes a cutting needle having a distal end formed with a blade, a cutting needle up-and-down motion mechanism having a first motor which is separate from the sewing machine motor and which is configured to generate drive power to move the cutting needle up and down independently of the needle bar up-and-down motion mechanism, so that a cut is formed by the blade as a result of the up-and-down motion of the cutting needle while the cutting needle is held in a manner such that an extending direction of the cutting needle corresponds with an extending direction of the needle bar, and a cutting needle rotating mechanism configured to rotate the cutting needle about a central axis line of the cutting needle directed to the extending direction.

DETAILED DESCRIPTION

A first embodiment will be described with reference to FIGS. 1 to 10B. The embodiment is directed to a household sewing machine which will hereinafter be referred to as "sewing machine M."

Figure 1:
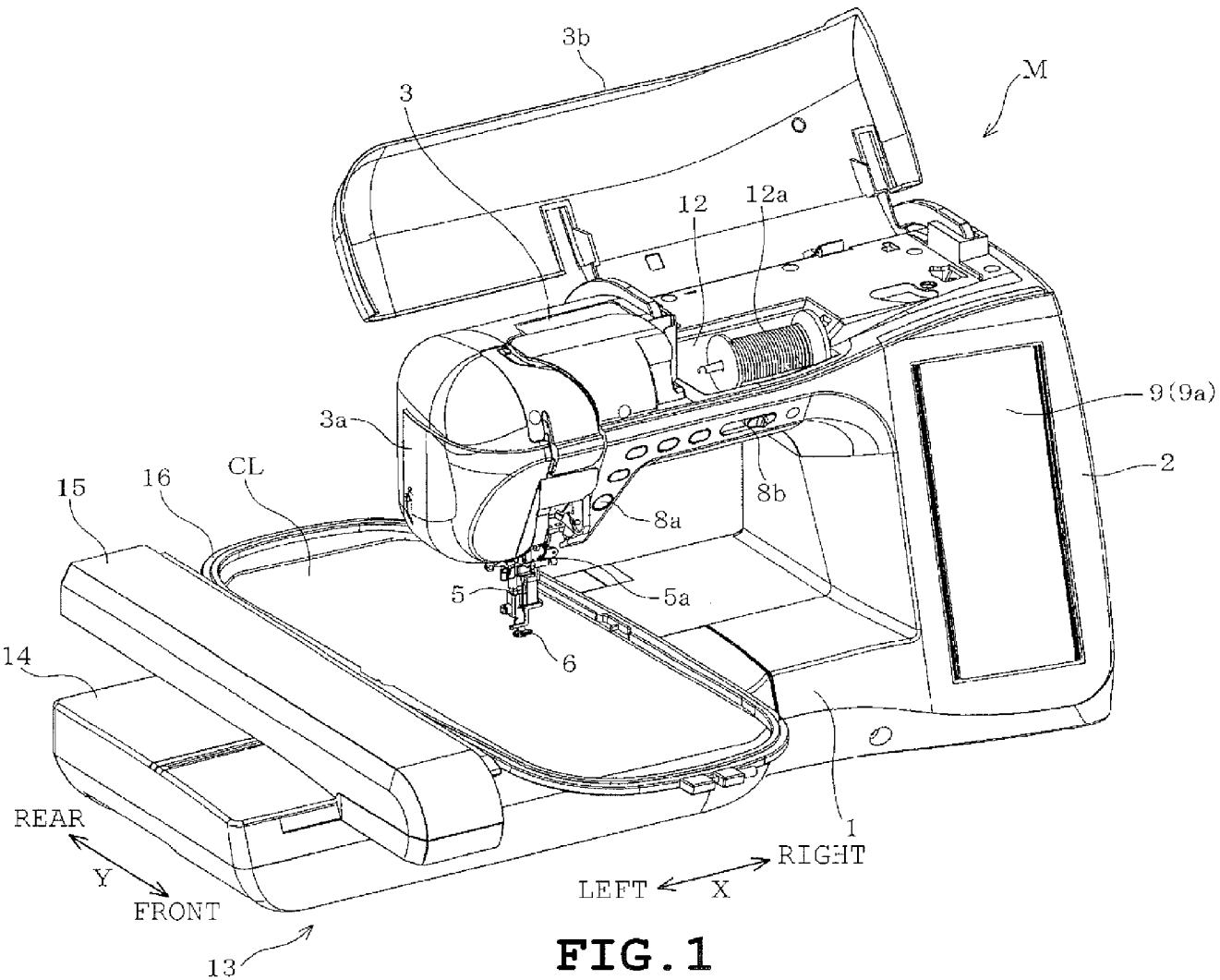
FIG. 1 is a perspective view of an entire sewing machine according to a first embodiment.

Referring to FIG. 1, the sewing machine M includes a bed part 1 extending in a right-left direction, a pillar standing upward from a right end of the bed part 1 and an arm extending leftward from an upper part of the pillar 2, all of which are integrally formed with the sewing machine M. A sewing machine shaft (not shown) is provided in the arm 3 so as to extend in the right-left direction. A sewing machine motor 4 (see FIG. 8) is provided in the pillar 2 to rotate the sewing machine shaft.

In the following description, the side where a user is located relative to the sewing machine M will be referred to as "front" of the sewing machine, that is, the front of the sewing machine is the side where switches and a display unit both of which will be described later are located in the sewing machine M. The side located opposite the front will be referred to as "rear." The side where the pillar 2 is located in the sewing machine M will be referred to as "right" and the distal end side of the arm 3 will be referred to as "left." The front-back direction is a Y direction and the direction perpendicular to the Y direction is an X direction.

A sewing machine head 3*a* is provided at the distal end side of the arm 3. A needle bar 5*a* and a presser bar (not shown) are provided on the sewing machine head 3*a*. The needle bar 5*a* has a lower end to which a sewing needle 5 is attached. The presser bar has a lower end on which a presser foot 6 is mounted. In the arm 3 are provided a needle bar up-and-down motion mechanism, a needle bar swinging mechanism, a take-up lever drive mechanism, a presser bar drive mechanism and the like, none of which are shown. The needle bar up-and-down motion mechanism moves the needle bar 5*a* up and down by rotation of the sewing machine shaft. The needle bar swinging mechanism swings the needle bar 5*a* in a direction (right-left direction) perpendicular to a cloth feed direction. The take-up lever drive mechanism moves a take-up lever up and down in synchronization with the up-and-down motion of the needle bar 5*a*. The presser bar drive mechanism moves the presser bar up and down.

The needle bar 5*a* protrudes downward from the sewing machine head 3*a*. The needle bar 5*a* has a lower end provided with a needle bar holder (not shown) for fixing the sewing needle 5. The sewing needle 5 is inserted into an insertion hole (not shown) formed in the lower end of the needle bar 5*a*. The needle bar holder has a set screw which is fastened or loosened for the purpose of attaching or detaching the sewing needle 5. When the sewing machine shaft is rotated one turn, the needle bar up-and-down motion mechanism is driven so that the needle bar 5*a* is reciprocated in the vertical direction between a bottom dead center and a top dead center.

A cover 3*b* is mounted on the arm 3 so as to open and close a top of the arm 3. A housing part 12 is defined in a front central interior of the arm 3. The housing part 12 is located so that a thread spool 12*a* is housed therein when the cover 3*b* is opened. A needle thread (not shown) drawn from the thread spool 12*a* is supplied to the sewing needle 5. The needle thread passes through a thread supply path including the take-up lever between the thread spool 12*a* and the sewing needle 5. Various switches including a start/stop switch 8*a* and a speed adjusting knob 8*b* are provided on the front side of the arm 3. The start/stop switch 8*a* instructs start and stop of a sewing operation of the sewing machine M. The speed adjusting knob 8*b* is operable to set a sewing speed, that is, a rotational speed of the sewing machine shaft.

A large-sized vertically long display 9 is mounted on a front of the pillar 2. The display 9 is capable of full color display. The display 9 displays various types of sewing patterns including ordinary patterns and embroidery patterns, various names of functions to be executed in a sewing work, various parameters and the like. A touch panel 9*a* (see FIG. 8) is mounted on a front of the display 9. The touch panel 9*a* has a plurality of touch keys comprising transparent electrodes. When the user touches one or more touch keys, a desirable sewing pattern can be selected, functions can be instructed and parameters can be set. A card slot into which a memory card is to be inserted is formed in a right side of the pillar 2 although not shown.

The bed part 1 has a top on which a needle plate (not shown) is mounted. In the bed part 1 are provided a cloth feed mechanism, a horizontal rotating shuttle, a thread cutting mechanism and the like, all of which are located below the needle plate 1*b* and none of which are shown. The cloth feed mechanism moves a feed dog in the up-down direction and the front-back direction. The horizontal rotating shuttle houses a bobbin and forms stitches in cooperation with the sewing needle 5. The thread cutting mechanism cuts the needle thread and the bobbin thread.

An embroidery frame transfer device 13 as an attachment is detachably attached to a left side of the bed part 1. The bed part 1 includes a part located on the left of a substantially central part thereof although the part is not shown in detail. The part of the bed part 1 is formed into a generally quadrangular prism extending leftward. This part will be referred to as "free arm bed." When the embroidery frame transfer device 13 is attached to the bed part 1, a fitting part 20*a* of the transfer device 13 is fitted with the free arm bed. The embroidery frame transfer device 13 transfers an embroidery frame 16 holding a workpiece cloth CL in two predetermined directions (X and Y directions) over the bed part 1 and a body 14 which will be described later. The cloth feed mechanism in the bed part 1 is configured to stop operating when the embroidery frame transfer device 13 is attached to the bed part 1. A sewing machine bed includes the bed part 1 and the attachment (the embroidery frame transfer device 13, in this case).

The embroidery frame transfer device 13 includes the body 14 and a moving portion 15. The body 14 is on a level with the upper surface of the bed part 1. The moving portion 15 is mounted on a top of the body 14 so as to be movable in the right-left direction. A carriage (not shown) is mounted on the moving portion 15 so as to be movable in the front-back direction. An embroidery frame 16 is detachably attached to the carriage. The body 14 encloses an X-direction transfer mechanism (not shown) therein. The X-direction transfer mechanism drives the carriage in the right-left direction together with the moving portion 15. The moving portion 15 encloses a Y-direction transfer mechanism (not shown) therein. The Y-direction transfer mechanism moves the carriage in the front-back direction. The embroidery frame 16 is moved in the X direction and the Y direction by driving drive motors (an X-axis motor 18 and a Y-axis motor 19 as will be described later; and see FIG. 8) of the X-direction and Y-direction transfer mechanisms respectively.

The embroidery frame transfer device 13 in the embodiment is provided with a cutting unit 30. As a result, when the embroidery frame transfer device 13 is attached to the bed part 1, the sewing machine M is capable of executing a cutting operation to form a cut using the cutting unit 30 as well as a normal embroidery sewing operation using the sewing needle 5.

Figure 2A:
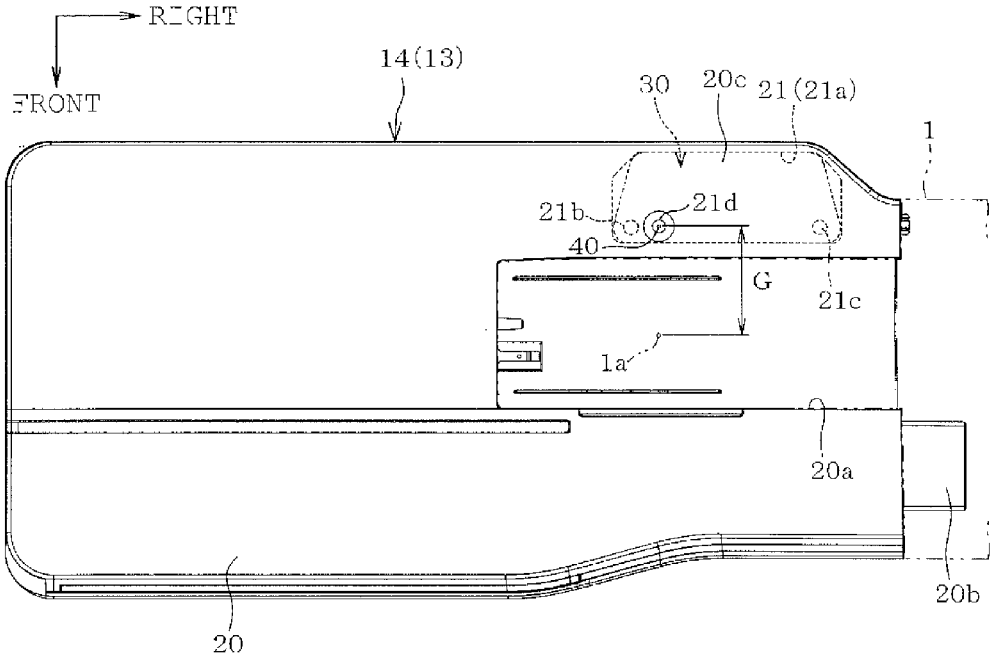
FIGS. 2A and 2B are a plan view and a bottom view of an embroidery frame transfer device respectively.
Figure 2B:
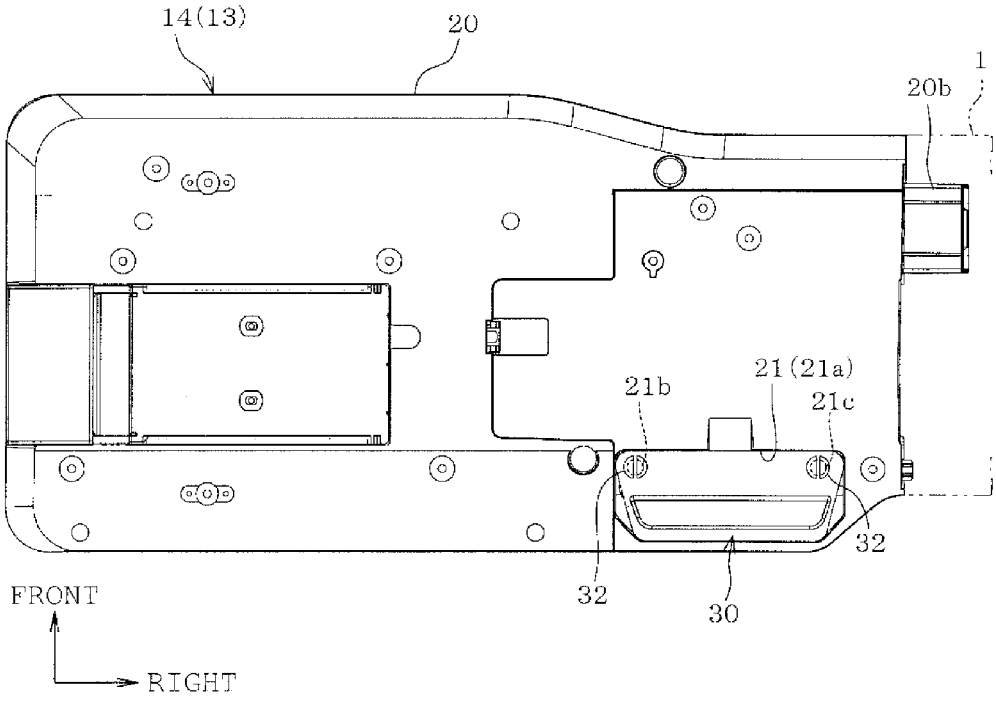

The construction of the embroidery frame transfer device 13 will be described with reference to FIGS. 2A and 2B, in which the moving portion 15 is not shown for convenience of description. The body 14 includes a resin housing 20 generally formed into the shape of a substantially rectangular box as shown in FIGS. 2A and 2B. A fitting portion 20*a* with an upper opening is provided on a right side of the housing 20. The fitting portion 20*a* is located in the middle of the housing 20 in the front-back direction. The body 14 is slidable rightward with respect to the bed part 1 so that the fitting portion 20*a* is fitted with the free arm bed of the bed part 1, whereby the embroidery frame transfer device 13 is attached to the sewing machine M. Further, a connector 20*b* is mounted on a front part of a right end of the housing 20. The connector 20*b* electrically connects the embroidery frame transfer device 13 to a control device 80 which will be described later. More specifically, as shown in FIG. 1, when the embroidery frame transfer device 13 is attached to the sewing machine M, the connector 20*b* is connected to a connected part (not shown) of the sewing machine M, with the result that the motors 18 and 19 and the like are electrically connected to the control device 80.

The X-direction transfer mechanism is incorporated in the housing 20. The housing 20 has a housing part 21 which is formed in a right rear thereof to house the cutting unit 30. The housing part 21 is a recess formed to be downwardly open in the housing 20. More specifically, the housing part 21 is a space defined by an upper surface 20*c* and a peripheral wall 21*a*. The cutting unit 30 is formed into a substantially trapezoidal shape as viewed in a plan view of FIG. 3A. The housing part 21 is also formed into a substantially trapezoidal shape matching the cutting unit 30 as shown in FIGS. 2A and 2B. Accordingly, when put into the housing part 21, the cutting unit 30 is housed in a correct direction by regulating the cutting unit 30 in the front-rear direction.

The upper surface 20*c* of the housing part 21 has two bosses 21*b* and 21*c* which are formed integrally therewith and located on front corners of the housing part 21 respectively as shown in FIG. 2A. The bosses 21*b* and 21*c* are paired and each formed into a columnar shape. The bosses 21*b* and 21*c* project downward from the upper surface 20*c* and have distal ends (lower ends) formed with screw holes (not shown) extending in the up-down direction, respectively. The upper surface 20*c* also has a circular hole 21*d* formed in a front part thereof. The hole 21*d* is formed so as to be located in the rear of a needle location 1*a* of the sewing needle 5 when the embroidery frame transfer device 13 is attached to the bed part 1.

Figure 3C:
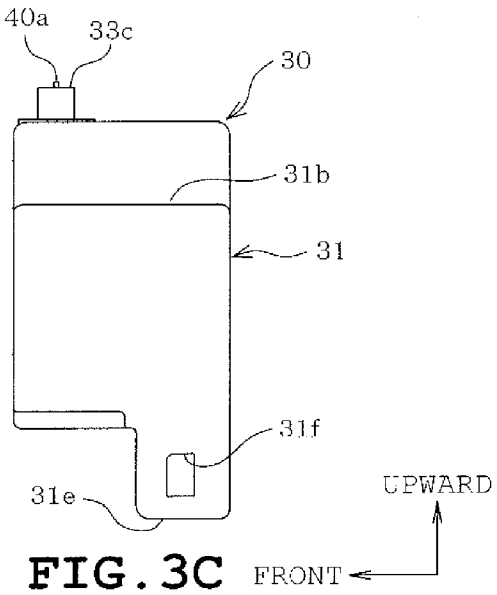
FIGS. 3A, 3B and 3C are a plan view, a front view and a right side elevation of a cutting unit respectively.
Figure 3A:
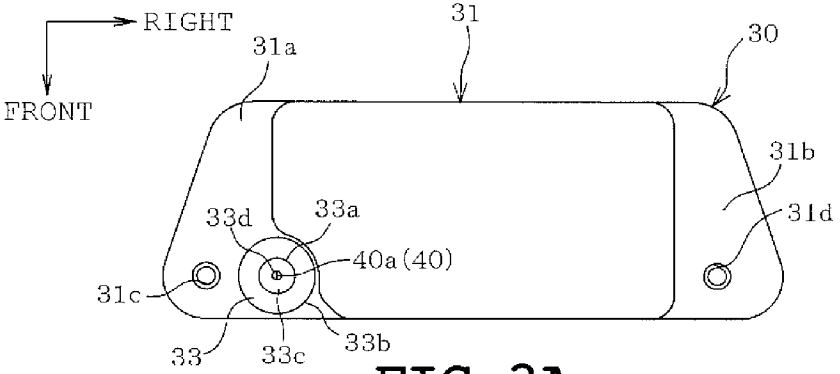
Figure 3B:
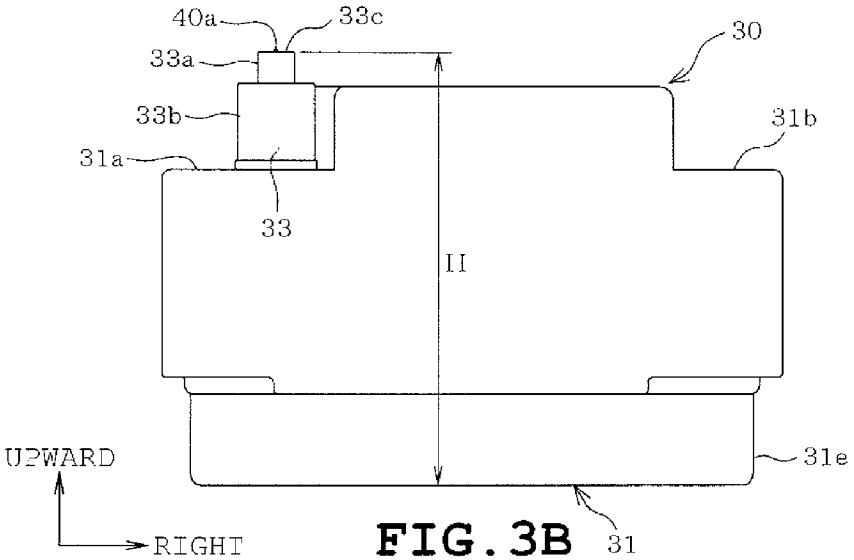

The cutting unit 30 will now be described. Referring to FIGS. 3A, 3B and 3C, the cutting unit 30 includes an enclosure 31 which is a horizontally long box-shaped resin case. The enclosure 31 is formed into a substantially trapezoidal shape in a planar view. The enclosure 31 is mounted by screws (not shown) to a machine frame 36 which will be described later. The enclosure 31 has two stepped portions 31*b* and 31*a* formed in right and left sides of an upper part thereof respectively. The stepped portions 31*a* and 31*b* are formed with respective through holes 31*c* and 31*d*. The holes 31*c* and 31*d* have larger outer diameters than the bosses 21*b* and 21*c*, respectively.

Figure 4:
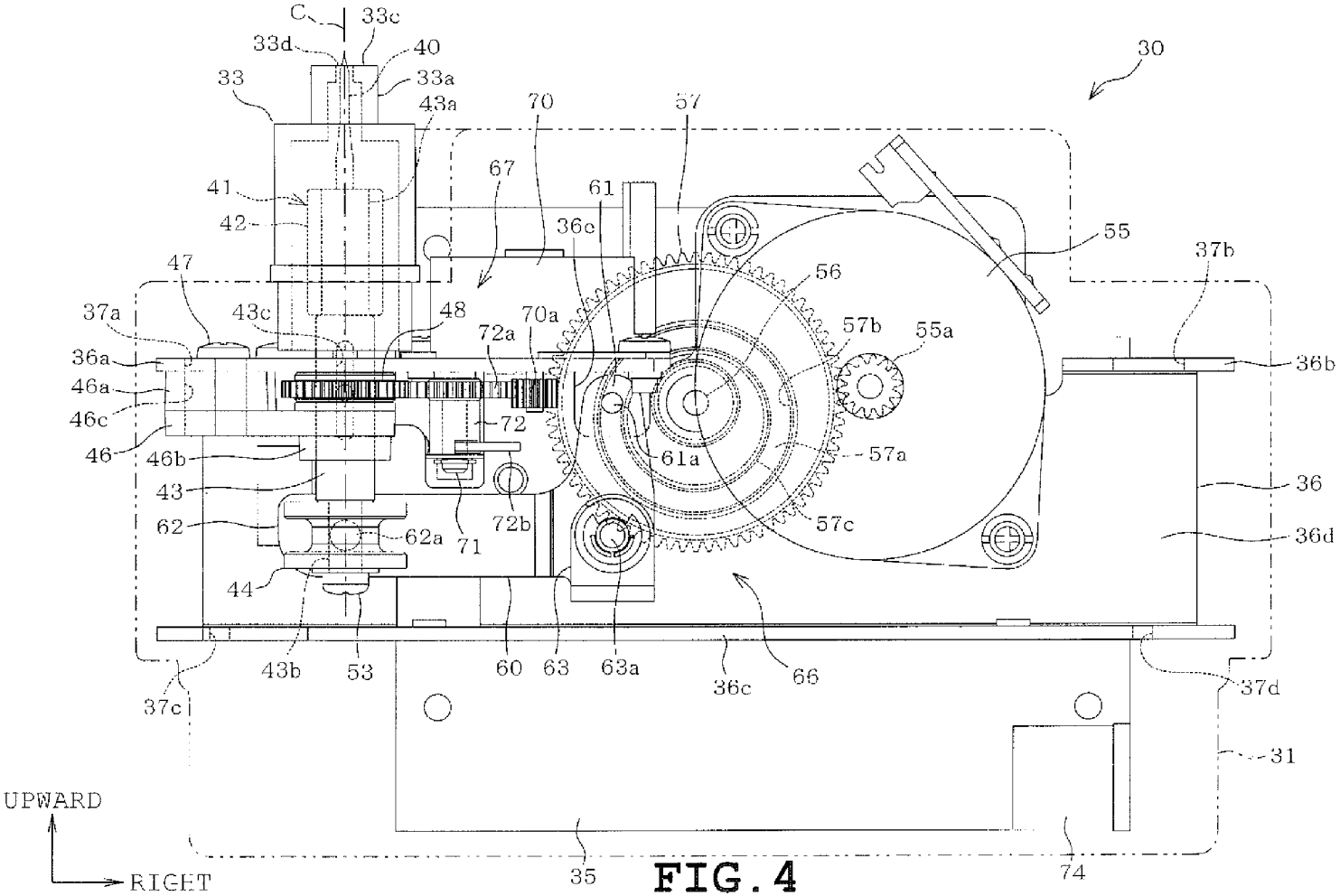
FIG. 4 is a front view of a cutting unit, showing an inner structure thereof.

The enclosure 31 has an underside formed with an extending portion 31*e* which extends downward according to a base plate 35 (see FIG. 4) which will be described later. The extending portion 31*e* has a right side formed with a connector opening 31*f*. The left stepped portion 31*a* of the enclosure 31 has a cylindrical needle case 33 including an upper smaller diameter portion 33*a* and a lower larger diameter portion 33*b*. The smaller diameter portion 33*a* is fitted into the hole 21*d* of the housing part 21. The enclosure 31 has a height H that is set such that a top 33*c* of the smaller diameter portion 33*a* is coplanar with the upper surface 20*c* of the housing part 21 when the cutting unit 30 is housed in the housing part 21. The smaller diameter portion 33*a* has a top 33*c* formed with a through hole 33*d* (see FIG. 3A). A cutting needle 40 as shown in FIG. 4 appears out of and disappears into the hole 33*d* of the smaller diameter portion 33*a*.

Figure 5:
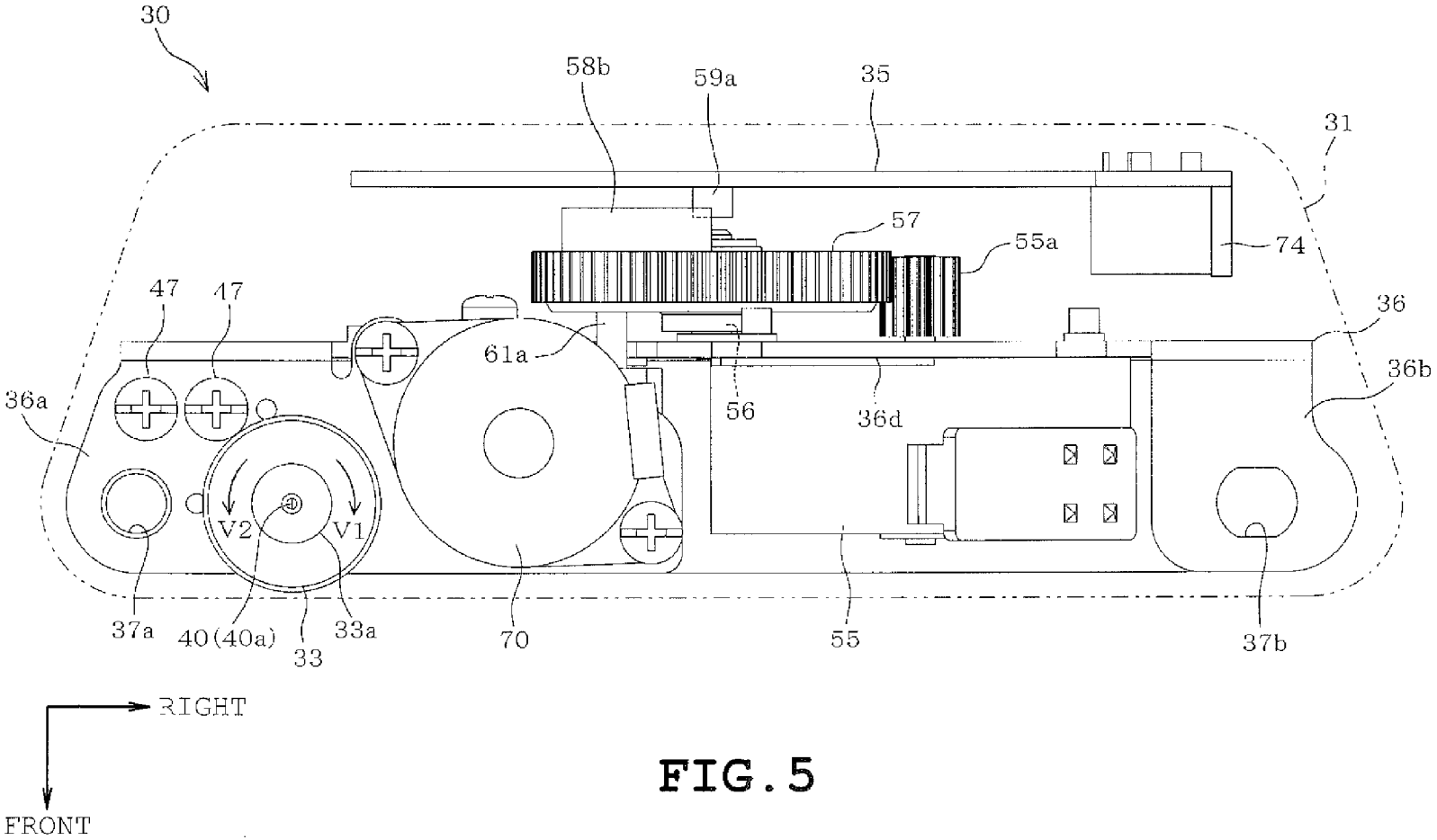
FIG. 5 is a plan view of the cutting unit.

The inner structure of the cutting unit 30 will now be described with reference to FIGS. 4 to 7. The base plate 35 in the enclosure 31 is eliminated and the inner structure of the cutting unit 30 is partially broken in FIG. 7. The machine frame 36 is provided in the enclosure 31. The machine frame 36 has a standing wall 36*d*, a left upper edge 36*a*, a right upper edge 36*b* and a lower edge 36*c* all of which are formed integrally with the machine frame 36. The standing wall 36*d* extends in the up-down direction. The left upper edge 36*a* extends forward from a left upper end of the standing wall 36*d*. The right upper edge 36*b* extends forward from a right upper end of the standing wall 36*d*. The lower edge 36*c* extends forward from a lower end of the standing wall 36*d*. The left upper edge 36*a* is formed with a through hole 37*a* as shown in FIG. 5. The right upper edge 36*b* is formed with a through hole 37*b*. The holes 37*a* and 37*b* are formed so as to correspond to the holes 31*c* and 31*d* of the enclosure 31 respectively. The hole 37*a* has a larger outer diameter than the boss 21*b*. The hole 37*b* is formed into an oval shape that is long in the right-left direction (an oval hole). The hole 37*b* has a right-left dimension that is larger than the outer diameter of the boss 21*c*. The hole 37*b* has a front-back dimension that is substantially equal to the outer diameter of the boss 21*c*. As a result, the boss 21*c* is fitted in the hole 37*b* almost without gap in the front-back direction. The lower edge 36*c* has two insertion holes 37*c* and 37*d* formed to correspond to the screw holes formed in the distal ends of the bosses 21*b* and 21*c*, respectively. The insertion holes 37*c* and 37*d* have smaller outer diameters than the bosses 21*b* and 21*c* respectively. The enclosure 31 has through holes (not shown) formed in a lower part thereof so as to correspond to the insertion holes 37*c* and 37*d* respectively. The through holes of the enclosure 31 have outer diameters equal to those of the insertion holes 37*c* and 37*d* respectively.

A manner of housing or attaching the cutting unit 30 into the housing part 21 will be described. The bosses 21*b* and 21*c* are inserted through the insertion holes 31*c* and 31*d* and the insertion holes 37*a* and 37*b* of the enclosure 31 respectively as the cutting unit 30 is inserted into the housing part 21, so that distal (lower) ends of the bosses 21*b* and 21*c* abut against an upper surface of the lower edge 36*c*. As a result, the machine frame 36 is positioned with respect to the up-down direction, whereby the cutting unit 30 is also positioned with respect to the up-down direction. In this state, two screws 32 as shown in FIG. 2B are inserted through the holes formed in the lower part of the enclosure 31 and the holes 37*c* and 37*d* to be screwed into the screw holes of the bosses 21*b* and 21*c*, respectively. The screws 32 have respective heads having larger outer diameters than the holes in the lower part of the enclosure 31. Accordingly, the enclosure 31 and the machine frame 36 are fixed by the screws 32 to the bosses 21*b* and 21*c* respectively. Thus, the cutting unit 30 is housed in the housing part 21 to be fixed in position. The screws 32 are loosened when the cutting unit 30 is to be detached from the housing part 21.

A cutting needle support 41 is mounted on a left part of the machine frame 36 so as to extend through the left upper edge 36*a*. The cutting needle support 41 includes the cutting needle 40, a support bar 43 extending in the up-down direction, a mounting cylinder 42 provided on an upper part of the support bar 43 and a connecting part 44 provided on a lower part of the support bar 43.

Figure 10A:
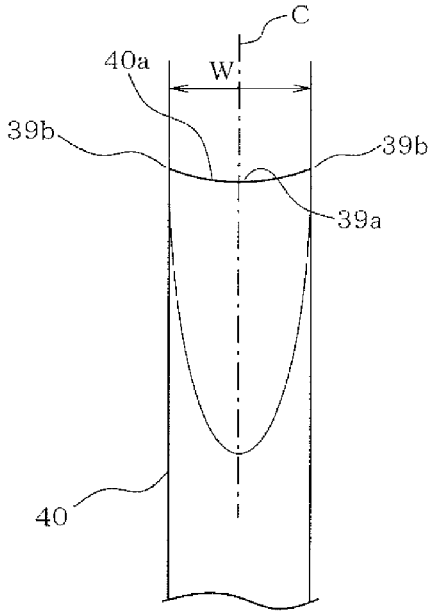
FIGS. 10A and 10B are an enlarged side elevation and an enlarged front view of a blade side of a cutting needle respectively.
Figure 10B:
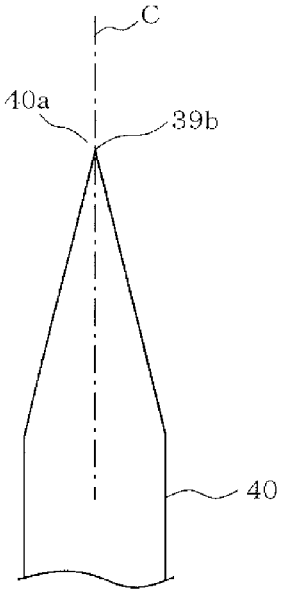

The cutting needle 40 has a haft 40*b* (see FIG. 7) serving as a base and formed into a substantially round bar shape and a blade 40*a* constituting a distal end (an upper end) of the cutting needle 40, both of which are formed integrally with the cutting needle 40. The blade 40*a* has a blade edge having a predetermined width W as shown in FIGS. 10A and 10B. In a stricter sense, the blade 40*a* is formed so that two widthwise ends 39*b* are slightly higher than a central part 39*a*. When the blade 40*a* forms a cut in the workpiece cloth CL, both ends 39*b* firstly come into contact with and cut into the workpiece cloth CL. Accordingly, the cut is formed by the blade 40*a* without displacement of the blade 40*a* relative to the workpiece cloth CL. The haft 40*b* has an outer periphery including a planar part 40*c* (see FIG. 7) although the planar part 40*c* is not shown in detail. As a result, the haft 40*b* has a D-cut shape, that is, a D-shaped cross-section perpendicular to the lengthwise direction thereof. The planar part 40*c* is formed to extend in a direction perpendicular to the direction (the right-left direction in FIG. 10) in which the blade 40*a* (the blade edge) extends.

Figure 7:
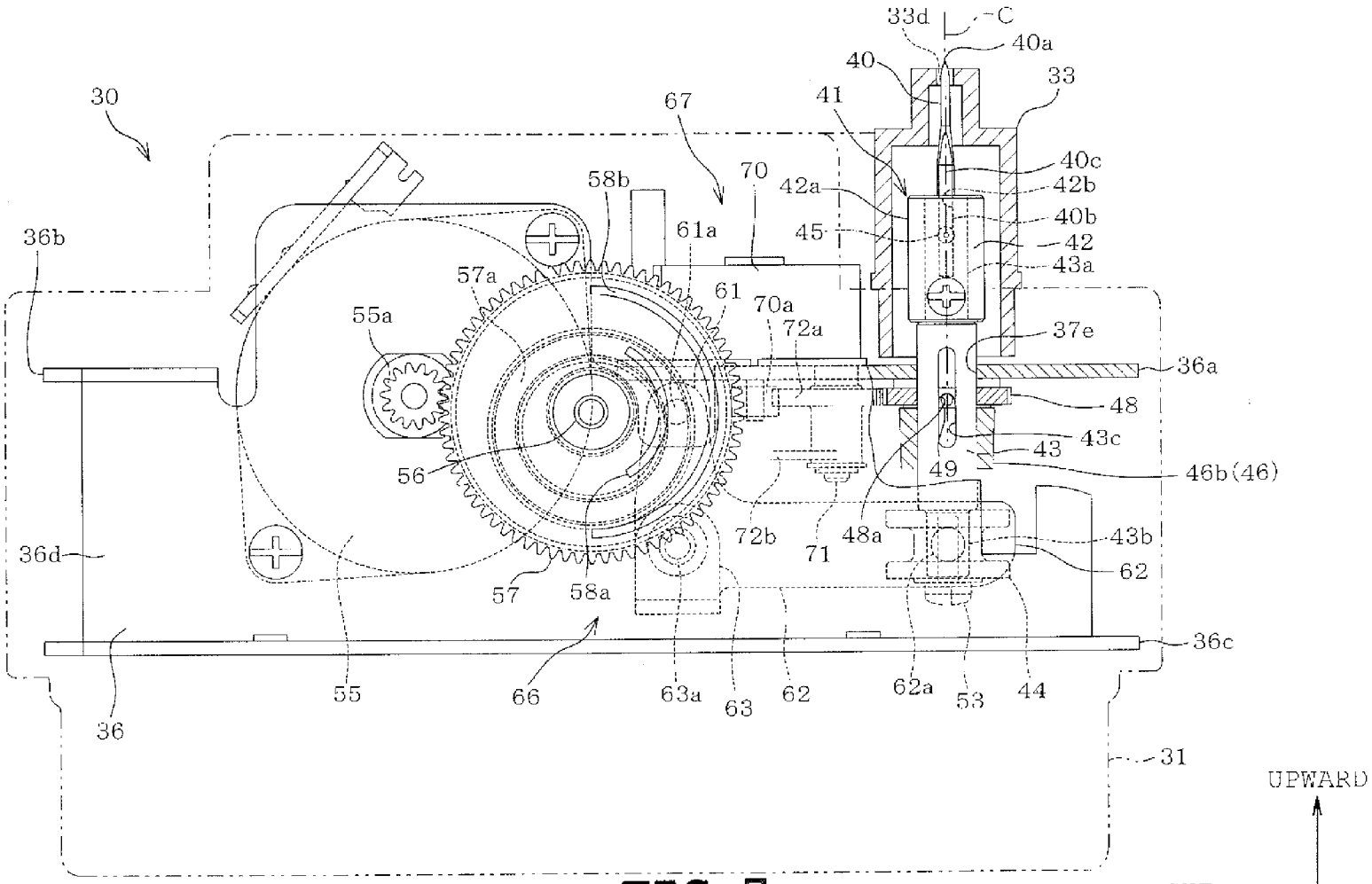
FIG. 7 is a partially broken rear view of the cutting unit, showing an inner structure thereof.

The support bar 43 includes a first smaller diameter portion 43*a* constituting an upper part thereof as shown in FIG. 7. The support bar 43 also includes a second smaller diameter portion 43*b* constituting a lower part thereof. The first smaller diameter portion 43*a* is formed with an insertion groove 42*b* extending in the up-down direction. The insertion groove 42*b* has two sidewalls and an inner wall although these walls are not shown in detail. The insertion groove 42*b* has a generally C-shaped cross-section perpendicular to a lengthwise direction thereof. The insertion groove 42*b* has a width (a dimension between the sidewalls) that is slightly larger than an outer diameter of the haft 40*b*. The haft 40*b* of the cutting needle 40 is inserted into the insertion groove 42*b*. In this case, the planar part 40*c* of the haft 40*b* is brought into face-to-face contact with the inner wall of the insertion groove 42*b*. The first smaller diameter portion 43*a* is covered and fixed by the mounting cylinder 42 provided for fixing the cutting needle 40. The mounting cylinder 42 has a side (a rear surface in FIG. 7) formed with a screw hole, with which a screw 45 is threadingly engaged. When the screw 45 is tightened, a distal end of the screw 45 abuts against the haft 40*b* of the cutting needle 40 to press the haft 40*b*. Thus, the planar part 40*c* is pressed against the inner wall of the insertion groove 42*b* with the result that the cutting needle 40 is fixed to the first smaller diameter portion 43*a*. The cutting needle 40 is thus mounted on the support bar 43 with the blade 40*a* being directed upward. The cutting needle 40 and the support bar 43 are configured so that a central axis line C of the cutting needle 40 corresponds with a central axis line of the support bar 43. The blade 40*a* has a widthwise central position located on the central axis line C.

The support bar 43 extends in the up-down direction through a through hole 37*e* (see FIG. 7) of the left upper edge 36*a* of the machine frame 36. Further, the support bar 43 is supported on a bearing member 46 so as to be movable up and down and rotatable. The bearing member 46 is fixed to the underside of the left upper edge 36*a* and has a left-half fixing part 46*a* and a right-half bearing part 46*b* both of which are formed integrally with the bearing member 46. The fixing part 46*a* is fixed to the left upper edge 36*a* by a screw 47. The bearing part 46*b* supports the support bar 43 so that the support bar 43 is rotatable about the central axis line C. The fixing part 46*a* is formed with an insertion hole 46*c* having an inner diameter substantially equal to the outer diameter of the boss 21*b*. The boss 21*b* is inserted through the insertion hole 46*c* so as to be fitted therein almost without gap. More specifically, when the cutting unit 30 is housed in the housing part 21, the boss 21*b* is fitted into the insertion hole 46*c* and the boss 21*c* is inserted into the insertion hole 37*b* of the right upper edge 36*b* so as to be fitted with the front and rear portions of the insertion hole 37*b*. Thus, the cutting unit is positioned correctly with respect to the front-back direction and the right-left direction.

The support bar 43 has a middle part in the direction of the central axis line C. The middle part is formed with an elongate hole 43*c* extending in the direction of the central axis line C. A pin 49 which will be described later is inserted through the hole 43*c* so as to be movable up and down. A first gear 48 is rotatably supported by the middle part of the support bar 43. The first gear 48 is disposed between the left upper edge 36*a* of the machine frame 36 and the bearing part 46*b*. The first gear 48 has an inner periphery formed with a groove 48*a* as shown in FIG. 7. The groove 48*a* is open at the underside of the first gear 48. The pin 49 is fitted in the groove 48*a* and inserted through the hole 43*c* of the support bar 43. As a result, the first gear 48 rotated via the pin 49 together with the support bar 43 and allows up-and-down motion of the support bar 43. The hole 43*c* is formed to extend in a direction perpendicular to an inner wall of the insertion groove 42*b*. Accordingly, the pin 49 has a central axis line having a direction corresponding to the direction in which the blade 40*a* (the blade edge) extends.

Figure 6:
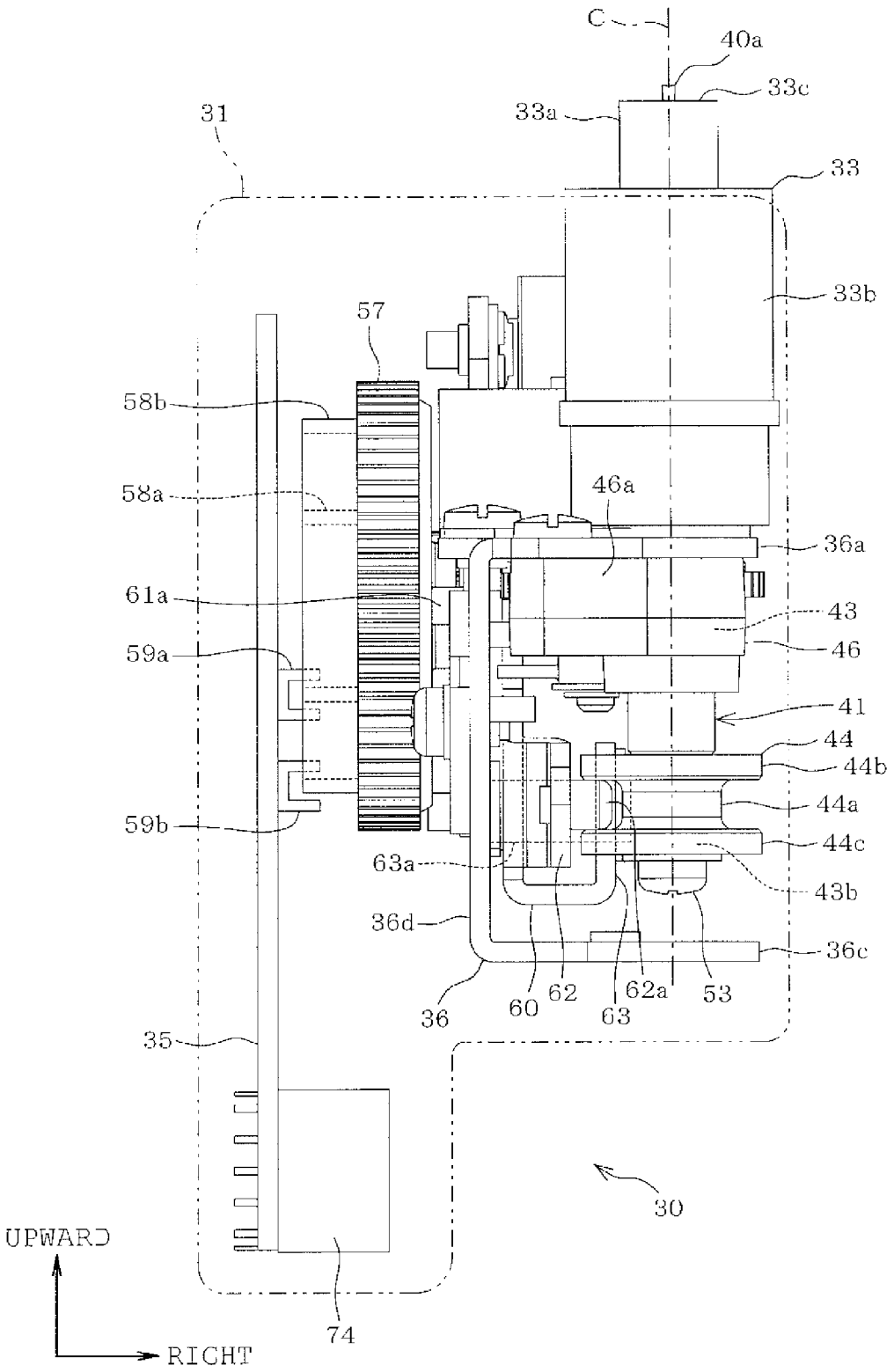
FIG. 6 is a left side elevation of the cutting unit.

The connecting part 44 is provided under the support bar 43. The connecting part 44 is connected to a second engagement pin 62*a* of a swing ring 60 which will be described later. The connecting part 44 has a cylindrical portion 44*a* and a pair of flanges 44*b* and 44*c* all of which are formed integrally therewith, as shown in FIG. 6. The cylindrical portion 44*a* is inserted into the second smaller diameter portion 43*b* of the support bar 43. The flanges 44*b* and 44*c* are formed on upper and lower ends of the cylindrical portion 44*a* respectively. The second smaller diameter portion 43*b* has a lower end formed with a screw hole (not shown) extending in the up-down direction. The connecting part 44 is fixed by a screw 53 screwed into the screw hole from below the second smaller diameter portion 43*b* while inserted in the second smaller diameter portion 43*b*. The flanges 44*b* and 44*c* are each formed into a disc shape such that the flanges 44*b* and 44*c* hold the second engagement pin 62*a* vertically therebetween. A distance between the flanges 44*b* and 44*c* is set to be slightly larger than an outer diameter of the second engagement pin 62*a*. Accordingly, the connecting part 44 is maintained in engagement with the second engagement pin 62*a* even when rotated together with the support bar 43. Thus, the connecting part 44 is rotatably connected to the second engagement pin 62*a*.

The following will describe the construction for driving the cutting needle support 41 up and down. A first motor 55 is mounted on the standing wall 36*d* of the machine frame 36 backward so as to be located at a slightly upper rightward position. The first motor 55 is a stepping motor, for example and has an output shaft to which a smaller diameter driving gear 55*a* is fixed, as shown in FIG. 5. Further, a gear shaft 56 extending rearward is mounted on the standing wall 36*d* so as to be located at a centrally upper rightward position. A larger diameter driven gear 57 is rotatably mounted on the gear shaft 56. The driven gear 57 is brought into mesh engagement with the driving gear 55*a*. The driven gear 57 has a grooved cam 57*a* formed in a front thereof as shown in FIG. 4. The grooved cam 57*a* has an annular shape eccentric to the gear shaft 56. The grooved cam 57*a* has peripheral walls 57*b* and 57*c* serving as cam surfaces. The peripheral walls 57*b* and 57*c* come into contact with a first engagement pin 61*a* of a swing link 60 which will be described later.

On the other hand, the driven gear 57 has a rear provided with a first arc portion 58*a* and a second arc portion 58*b* formed integrally therewith, as shown in FIG. 7. The first and second arc portions 58*a* and 58*b* are concentric and are each formed into the shape of a thin rib protruding rearward. The base plate 35 is opposed to the standing wall 36*d* of the machine frame 36 and disposed in the rear of the first and second arc portions 58*a* and 58*b*. The base plate 35 includes up-down position sensors 59*a* and 59*b* corresponding to the first and second arc portions 58*a* and 58*b* respectively. The up-down position sensors 59*a* and 59*b* detect rotation angles of circumferential ends of the first and second arc portions 58*a* and 58*b* respectively. The up-down position sensors 59*a* and 59*b* are comprised of photointerrupters respectively. Rotation angles of the first and second arc portions 58*a* and 58*b* are detected by the up-down position sensors 59*a* and 59*b* respectively, whereby a horizontal position of the first engagement pin 61*a* engaging the grooved cam 57*a* is determined. Thus, the control device 80 detects a vertical position of the cutting needle 40 based on detection of the rotation angles of the arc portions 58*a* and 58*b* by the respective sensors 59*a* and 59*b*. The sensors 59*a* and 59*b* serve as a vertical position detection unit which detects the vertical position of the cutting needle 40.

The swing link 60 is disposed along a front surface of the standing wall 36*d* in the machine frame 36 as shown in FIG. 4. In this case, the swing link 60 is located between the driven gear 57 and the connecting part 44 of the cutting needle support 41. Further, a frontwardly extending pivotably-supporting shaft 63*a* is mounted on a lower central part of the standing wall 36*d*. The swing link 60 is pivotably supported by the shaft 63*a* so as to be swingable. The swing link 60 is constructed of a plate-shaped member and includes an upwardly extending upper arm 61 and a leftwardly extending left arm 62 both of which are formed into an inverted L-shape. The swing link 60 further includes a supported part (a proximal end) which is folded back to the front side thereby to be formed into a U-shape in a side view as shown in FIG. 6. The supported part is provided with a folded piece 63 having a through hole (not shown) through which the shaft 63*a* extends.

The upper arm 61 has an upper end from which a first engagement pin 61*a* protrudes. The first engagement pin 61*a* is located at a rear surface side facing an upper cutout 36*e* (see FIG. 4). The first engagement pin 61*a* is inserted into the grooved cam 57*a* of the driven gear 57 thereby to be in engagement with the grooved cam 57*a*. On the other hand, the left arm 62 has a left end from which a second engagement pin 62*a* protrudes. The second engagement pin 62*a* is located at the front surface side so as to be aligned with the connecting part 44. The second engagement pin 62*a* is held between the flanges 44*b* and 44*c* of the connecting part 44 to be in engagement with the flanges 44*b* and 44*c*. The first engagement pin 61*a* serves as a first end and the second engagement pin 62*a* serves as a second end in the swing link 60.

Upon drive of the first motor 55, the driven gear 57 is rotated via the driving gear 55*a*. The first engagement pin 61*a* engaging the grooved cam 57*a* is moved in the right-left direction (reciprocal movement) with the result that the swing link 60 is swung about the shaft 63*a*. The swing of the swing link 60 moves the second engagement pin 62*a* in the up-down direction (reciprocal movement). The connecting part 44 is moved in the up-down direction by the second engagement pin 62*a* moved in the up-down direction. Thus, the cutting needle support 41 is moved up and down by driving the first motor 55, so that the cutting needle 40 is moved reciprocally between a top dead point and a bottom dead point. When the cutting needle 40 is located at the top dead point, the blade 40*a* projects from the top 33*c* of the enclosure 31 (the upper surface 20*c* of the embroidery frame transfer device 13). When the cutting needle 40 is located at the bottom dead point, the blade 40*a* is located below the top 33*c*. An amount of projection of the blade 40*a* is set to, for example, 5 mm when the cutting needle 40 is located at the top dead point. A cutting needle up-and-down motion mechanism 66 moving the cutting needle 40 up and down is thus constructed of the first motor 55, the gears 55*a* and 57, the swing link 60, the cutting needle support 41 and the like.

The cutting unit 30 includes a cutting needle rotating mechanism 67 which rotates the cutting needle 40 about the central axis line C. In more detail, a second motor 70 is mounted on the left upper edge 36*a* of the machine frame 36 to a downward direction so as to be located in the right of the cutting needle support 41. The second motor 70 is a stepping motor, for example. The second motor 70 has an output shaft to which a smaller diameter driving gear 70*a* is fixed. A downwardly extending gear shaft 71 is mounted on the left upper edge 36*a* of the machine frame 36 so as to be located between the cutting needle support 41 and the second motor 70. A driven gear 72 is rotatably mounted on the gear shaft 71.

The driven gear 72 has a cylindrical part through which the gear shaft 71 is inserted, a first gear 72*a* mounted on an upper end of the cylindrical part and a sectorial part 72*b* formed in a lower end of the cylindrical part, all of which are formed integrally with the driven gear 72, as shown in FIGS. 4 and 7. The sectorial part 72*b* is formed into the shape of a plate with an arc-shaped outer periphery in a planar view. A rotation angle sensor 73 (shown only in FIG. 8) is provided on the standing wall 36*d* of the machine frame 36. The rotation angle sensor 73 detects a rotation angle of a circumferential end of the sectorial part 72*b*. The rotation angle sensor 73 is configured of a photointerrupter. The control device 80 detects a rotation angle of the blade 40*a* of the cutting needle 40 based on a detection signal of the rotation angle sensor 73.

The first gear 72*a* of the driven gear 72 is brought into mesh engagement with both the driving gear 70*a* of the second motor 70 and the first gear 48 of the cutting needle support 41. The first gear 72*a* has gear teeth the number of which is equal to that of the second gear 48. The driving gear 70*a*, the first gear 72*a* and the second gear 48 constitute a gear train constructed by combining the three spur gears. Accordingly, the driving gear 70*a* has a rotation direction that is the same as a rotation direction of the second gear 48. When the second motor 70 is driven for normal rotation or for reverse rotation, the first gear 72*a* is rotated via the driving gear 70*a*. The second gear 48 is rotated together with the cutting needle support 41 with rotation of the first gear 72*a*. In this case, when the second motor 70 is rotated clockwise in a planar view, the cutting needle 40 is also rotated clockwise (in the direction of arrow V1 in FIG. 5). On the other hand, when the second motor 70 is rotated counterclockwise, the cutting needle 40 is also rotated counterclockwise (in the direction of arrow V2 in FIG. 5). Further, the first gear 72*a* has the gear teeth the number of which is equal to that of the second gear 48 as described above. When the first gear 72*a* is rotated one turn, the second gear 48 is also rotated one turn accordingly. Therefore, a rotation angle of the second gear 48 is detected by detecting a rotation angle of the first gear 72*a*. The rotation angle of the second gear 48 accordingly corresponds to a rotation angle of the blade 40*a* of the cutting needle 40.

Thus, the second motor 70 and the gears 48, 70*a* and 72*a* constitute a cutting needle rotating mechanism 67 which rotates the cutting needle 40 about the central axis line C. The cutting needle up-and-down motion mechanism 66 and the cutting needle rotating mechanism 67 are assembled to the machine frame 36 to constitute one unit housed in the enclosure 31 together with the cutting needle 40, that is, the cutting unit 30. The cutting unit may be modified appropriately as will be described in detail later. For example, the cutting unit may be incorporated in the embroidery frame transfer device 13. In this case, the enclosure 31 may be eliminated, and the cutting needle up-and-down motion mechanism 66 and the cutting needle rotating mechanism 67 are assembled in the housing 20 of the embroidery frame transfer device 13.

A connector 74 is mounted in a right lower part of the base 35 in the cutting unit 30 (see FIG. 4 and the like). The connector 74 faces the connector opening 31*f* (see FIG. 3C) of the enclosure and is configured to electrically connect electrical components including the motors 55 and 70, the sensors 59*a*, 59*b*, 73 and the like to the control device 80. A cable (not shown) connected to the connector 74 is further connected to the connected part (not shown) provided in the rear or the right surface of the sewing machine M in a state where the cutting unit 30 is attached to the housing part 21 of the embroidery frame transfer device 13, as shown in FIG. 2A, with the result that the electrical components of the cutting unit 30 are electrically connected to the control device 80.

Figure 8:
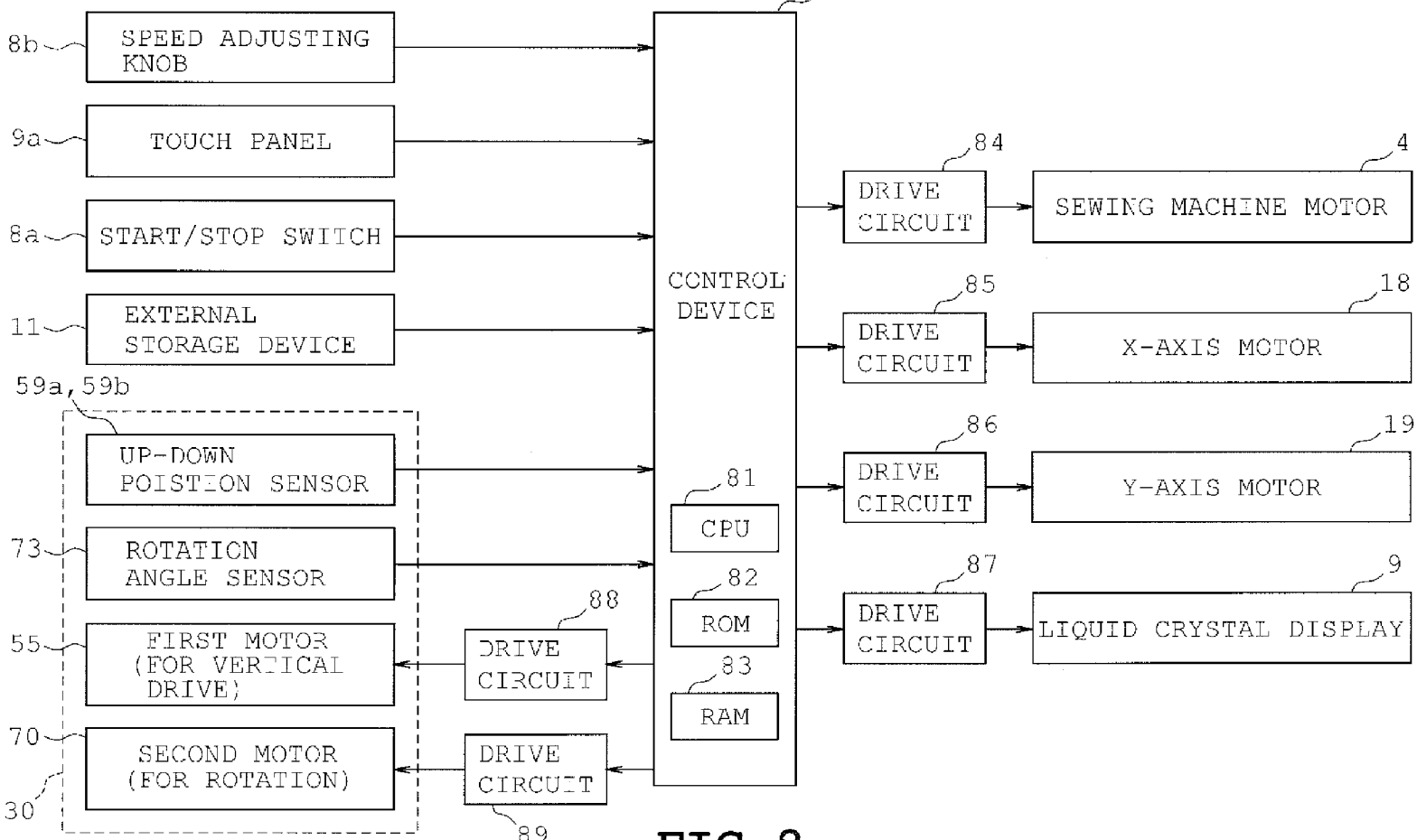
FIG. 8 is a block diagram showing an electrical arrangement.

The control system of the sewing machine M will now be described with reference to FIG. 8. The control device 80 is configured to be microcomputer-centric and includes a CPU 81, a ROM 82 and a RAM 83. To the control device 80 are connected the start/stop switch 8*a*, the speed adjusting knob 8*b*, the touch panel 9*a* and drive circuits 84, 85, 86 and 87 driving the sewing machine motor 4, the X-axis motor 18, the Y-axis motor 19 and the display 9 respectively. The up-down position sensors 59*a* and 59*b* and the rotation angle sensor 73 are also connected to the control device 80. Drive circuits 88 and 89 driving the first and second motors 55 and 70 are further connected to the control device 80 respectively. An external storage device 11 such as a memory card is still further connected to the control device 80.

The ROM 82 stores embroidery data of various types of embroidery patterns, cutting data, a sewing control program and the like. The embroidery data specifies a needle location for every stitch to sew an embroidery pattern on the workpiece cloth using the sewing needle 5 as well known in the art. More specifically, an XY coordinate system is defined in the sewing machine M. The XY coordinate system has an origin ((X,Y)=(0,0) which is a location where a central point (not shown) of a sewable region automatically set according to a type of the embroidery frame 16 corresponds with the needle location 1*a*. The embroidery data has coordinate data based on which the sewing needle 5 is caused to drop sequentially, as needle location data defined by the XY coordinate system (embroidery coordinate system) and indicative of an amount of transfer of the embroidery frame 16 in the X direction and the Y direction. The control device 80 controls the sewing machine motor 4, the X-axis motor 18 and the Y-axis motor 19 based on the embroidery data thereby to automatically execute an embroidery sewing operation for the workpiece cloth CL.

Figure 9:
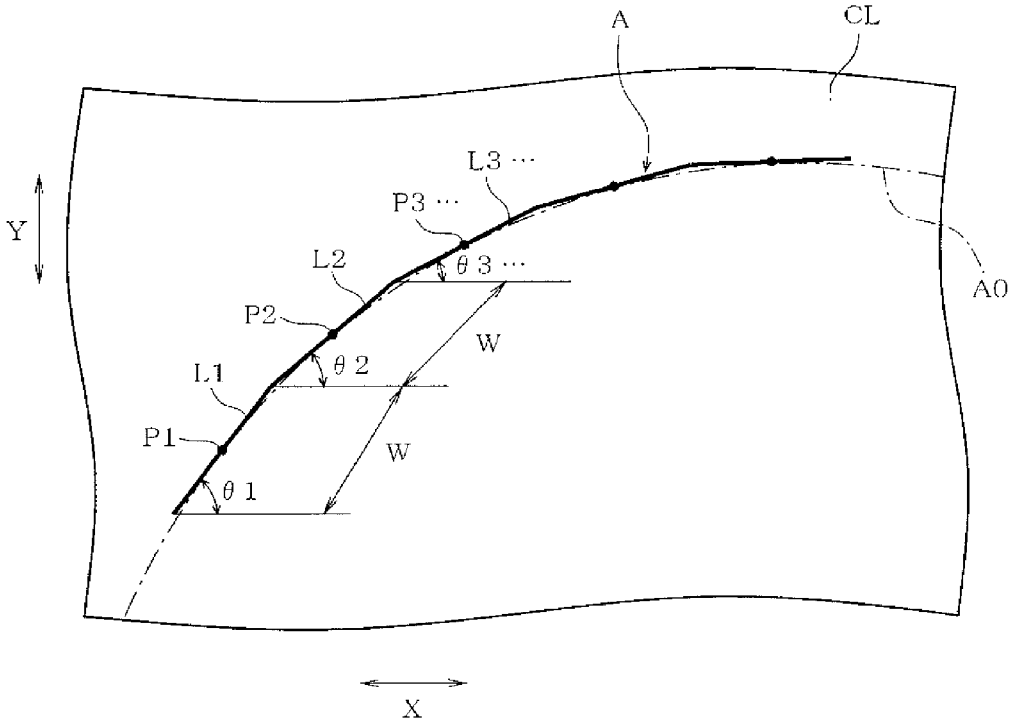
FIG. 9 is a diagrammatic view showing a rotational angle of a cutting needle and cut pattern.

The cutting data gives instructions on a cut location and a cut angle for forming a predetermined cut pattern on the workpiece cloth CL using the cutting needle 40. The cutting data will be described with an example in which a substantially circular cut pattern is cut out of the workpiece cloth CL by the cutting needle 40. FIG. 9 shows a partially enlarged substantially circular cut pattern (substantially arc-shaped) formed on the workpiece cloth CL. In the XY coordinate system, the direction from left to right of the sewing machine M (right in FIG. 9) is a positive direction of the X axis, and the direction from the front to the rear of the sewing machine M (upward in FIG. 9) is a negative direction of the Y axis. Further, the counterclockwise direction with respect to the X axis in FIG. 9 is positive (+) and the clockwise direction is negative (−).

In more detail, a cut pattern A is composed of a plurality of linear cuts L1, L2, L3 and so on continuing along a circle A0 of intended cutting line (shown by alternate long and two short dashes line). Therefore, the cut pattern A is formed into a substantially circular shape. Each one of the cuts L1, L2, L3 and so on has a length that is equal to a width W of the blade 40*a* of the cutting needle 40. Further, middle points P1, P2, P3 and so on of the cuts L1, L2, L3 and so on are cut positions corresponding to the central axis line C of the cutting needle 40.

Angles θ1, θ2, θ3 and so on made between the X axis and the cuts L1, L2, L3 and so on are set to form tangent lines at the points P1, P2, P3 and so on, on the circle A0. The cutting data includes coordinate data and angle data. The coordinate data is data of cut positions corresponding to the cut positions P1, P2, P3 and so on respectively. The angle data is indicative of the angles θ1, θ2, θ3 and so on set for the respective cut positions P1, P2, P3 and so on. More specifically, the cut position data is transfer data based on which the embroidery frame 16 is transferred in the X and Y directions and is indicative of a transfer amount to transfer the embroidery frame 16 in the X and Y directions and a cut position for every reciprocal up-and-down motion of the cutting needle 40. The angle data is set to correspond to the cut position data and is indicative of a rotation angle (a cut angle) for every reciprocal up-and-down motion of the cutting needle 40.

Based on the cutting data, the control device 80 controls the X-axis motor 18, the Y-axis motor 19, the first motor 55 and the second motor 70 to automatically execute a cutting operation for the workpiece cloth CL. The control device 80 further controls the cutting needle rotating mechanism 67 so that the cutting needle 40 is rotated when the blade 40*a* of the cutting needle 40 is located below the workpiece cloth CL held on the embroidery frame 16, based on detection signals of the up-down position sensors 59*a* and 59*b*. The control manner will be described in detail later.

The cut position where the cutting needle 40 is moved up and down so that a cut is formed by the blade 40*a* is spaced away rearward from the needle location 1*a* of the sewing needle 5 by a predetermined distance G (see FIG. 2A). Further, the cutting data is specified by the same embroidery coordinate system as applied to the embroidery data. The cut position data is therefore set to a value offset by distance G from Y coordinate data in order that the cut position on the workpiece cloth CL by the cutting needle 40 may correspond to the needle drop location of the sewing needle 5. As a result, a cut pattern can be formed along an outline of the embroidery pattern on the workpiece cloth CL or the embroidery pattern can be formed around the cut pattern without detachment of the embroidery frame 16 and without correction of cutting data and embroidery data. Although the cutting data is generated together with the embroidery data and stored in the ROM 82, the cutting data may be stored in another internal storage device in the sewing machine M or the external storage device 11 such as memory card. For example, when the embroidery data and the cutting data are stored in the external storage device 11, the control device 80 reads these data from the RAM 83 to execute the control.

The above-described configuration will work as follows. When a predetermined cut pattern is formed together with the embroidery pattern on the workpiece cloth CL, the user attaches the cutting unit 30 to the embroidery frame transfer device 13. The cutting unit 30 will be attached in the following manner. More specifically, the user puts the embroidery frame transfer device 13 into the cutting unit 30 from the underside of the embroidery frame transfer device 13 with the needle case 33 side (the blade 40*a* side) being upwardly directed (see FIG. 2A). The cutting unit 30 is then fixed by the screws 32. Thus, the cutting unit 30 is attached into the housing part 21 of the embroidery frame transfer device 13 with the blade 40*a* of the cutting needle 40 being directed upward.

The user then attaches the embroidery frame transfer device 13 to the free arm bed of the bed part 1. The user also sets the embroidery frame 16 holding the workpiece cloth CL onto the carriage of the moving portion 15 of the embroidery frame transfer device 13. A pattern selecting screen (not shown) is then displayed on the display 9, and a desired embroidery pattern and cut pattern A are selected by a touch operation onto the touch panel 9*a*. As a result, the control device 80 reads cutting data of the cut pattern A and embroidery data from the ROM 82 to store the read data in the RAM 83. When start of cutting is instructed by a touch operation onto the touch panel 9*a*, the control device 80 executes a cutting operation for the workpiece cloth CL based on the cutting data stored in the RAM 83. Upon start of the cutting operation, the control device 80 detects a position of the cutting needle 40 in the up-down direction based on signals supplied from the up-down position sensors 59*a* and 59*b*.

When the detected position of the cutting needle 40 (the blade 40*a*) is away downward from the workpiece cloth CL, the control device 80 drives the X-axis motor 18 and the Y-axis motor 19 to move the embroidery frame 16 so that the cutting start point P1 (see FIG. 9) of the workpiece cloth CL is located on the central axis line C of the cutting needle 40. The control device 80 then drives the cutting needle rotating mechanism 67 based on a detection signal of the rotation angle sensor 73, thereby rotating the cutting needle 40 so that a cut angle is set to θ1. Subsequently, the control device 80 drives the cutting needle up-and-down motion mechanism 66 to move the cutting needle 40 upward, thereby forming a cut L1 in the workpiece cloth CL by the blade 40*a*.

After having formed the cut L1 in the workpiece cloth CL, the control device 80 drives the cutting needle up-and-down motion mechanism 66 to move the cutting needle 40 downward. The control device 80 detects a vertical position of the cutting needle 40 based on detection signals supplied from the up-down position sensors 59*a* and 59*b*. When the detected position of the cutting needle 40 (the blade 40*a*) is away downward from the workpiece cloth CL, the control device 80 drives the X-axis motor 18 and the Y-axis motor 19 to move the embroidery frame 16 so that the cutting start point P2 of the workpiece cloth CL is located on the central axis line C of the cutting needle 40. The control device 80 further drives the cutting needle rotating mechanism 67 to rotate the cutting needle 40, thereby setting the cut angle to θ2. Subsequently, the control device 80 drives the cutting needle up-and-down motion mechanism 66 to move the cutting needle 40 upward, so that the cut L2 is formed in the workpiece cloth CL by the blade 40*a*. The control device 80 executes the cutting operation in the same manner as described above regarding the third cut L3 onward. Thus, the embroidery frame 16 (the workpiece cloth CL) is moved while the cutting needle 40 is moved up and down, so that the cuts L1, L2, L3 and so on are sequentially formed. As a result, a substantially circular cut pattern A is formed on the workpiece cloth CL. The control device 80 returns the cutting needle 40 to a standby position after the forming of the cut pattern A, thereby ending the cutting operation.

Subsequently, the control device 80 executes an embroidery sewing operation based on the embroidery data, so that an embroidery pattern is sewn on the workpiece cloth CL formed with the cut pattern A. In this case, the embroidery pattern can be formed along a circumferential edge of the cut pattern A so as to match the cut pattern A as described above, for example. Alternatively, the control device 80 may execute the cutting operation based on the cutting data after having completed the embroidery sewing operation based on the embroidery data. In this case, too, the cut pattern A can be formed so as to match the embroidery pattern sewn on the workpiece cloth CL.

As described above, the sewing machine M of the embodiment includes the cutting needle 40 having the blade 40*a* on the distal end thereof, the cutting needle up-and-down motion mechanism 66 which moves the cutting needle 40 up and down independently of the needle bar up-and-down motion mechanism and the cutting unit 30 having the cut position at which a cut is formed by the blade 40*a* by moving the cutting needle 40 up and down and corresponds to the position the predetermined distance away from the needle location 1*a* of the sewing needle 5 in the sewing machine bed.

According to the above-described construction, the sewing machine M can form cuts in the workpiece cloth CL by the cutting needle 40 of the cutting unit 30 as well as sewing on the workpiece cloth CL by the sewing needle 5. Accordingly, the cutting and the sewing of the workpiece cloth CL can continuously be carried out without use of two sewing machines as in the prior art. Further, the needle location 1*a* of the sewing needle 5 has a predetermined positional relationship with the cutting position of the cutting needle 40. Accordingly, the cutting position can accurately be matched with the sewing position only by offsetting the cut location by the predetermined distance with respect to the needle location in execution of cutting and sewing of the workpiece cloth CL.

The cutting unit 30 is mounted on the sewing machine bed with the blade 40*a* of the cutting needle 40 being in an upward direction. Further, the sewing machine bed includes an attachment detachably attached to the bed part 1. As a result, a cutting function by the cutting needle 40 can be added to the sewing machine M without an increase in the size of the head 3*a*.

The embroidery frame transfer device 13 transfers the embroidery frame 16 holding the workpiece cloth CL in two predetermined directions. Accordingly, the embroidery pattern can be formed by the sewing needle 5 or the cut can be formed by the cutting needle 40 while the embroidery frame 16 holding the workpiece cloth CL is transferred by the embroidery frame transfer device 13. The predetermined directions should not be limited to the X and Y directions in a plane on the sewing machine bed. For example, the embroidery frame transfer device may transfer the embroidery frame in the rotation direction (θ direction) and the radial direction (R direction) in the plane on the sewing machine bed.

The embroidery frame transfer device 13 is provided with the housing part 21 which detachably houses the cutting unit 30. According to this, the cutting unit 30 can be housed in the housing part 21 of the embroidery frame transfer device 13 and can be attached to and detached from the housing part 21 when needed. Further, the cutting unit 30 may be sold as optional accessories independently of the sewing machine M and the embroidery frame transfer device 13. In this case, the user can purchase the cutting unit 30 when he/she needs. As a result, the sewing machine M can meet diverse needs of the users.

The housing part 21 is formed in the embroidery frame transfer device 13 so as to be open downward. According to this, the housing part 21 has a simple housing structure which can house the cutting unit 30 without spoiling an appearance of the embroidery frame transfer device 13.

The cutting unit 30 includes the enclosure 31 having the top formed with the hole 33*d* through which the blade 40*a* appears and disappears with up-and-down motion of the cutting needle 40. According to this, the cutting needle 40 incorporated in the enclosure 31 can be protected. Further, the cutting unit 30 can be handled easily since the user can attach and detach the cutting unit 30 without touching the cutting needle 40.

The control device 80 controls the cutting needle rotating mechanism 67 so that the cutting needle 40 is rotated depending on the transfer direction of the embroidery frame 16 on the basis of transfer data. More specifically, the control device 80 acts as a rotation control unit. According to this, for example, in order that cuts may be formed along an intended cutting line of the cut pattern A, the cuts can be formed with the direction of the blade 40*a* matching the transfer direction. Further, the rotation angle of the cutting needle 40 may be set to correspond to transfer data as included in generated cutting data as described in the foregoing embodiment. Alternatively, the transfer direction may be obtained from the transfer data by the control device 80 and the rotation angle may be set so that the direction of the blade 40*a* matches the transfer direction. For example, a rectangular cut pattern (not shown) has a long side and a short side both of which serve as transfer directions. Directions of the long and short sides of the rectangle are calculated based on the transfer data. The rotation angle of the cutting needle 40 is set so that the blade 40*a* is directed in the directions of the long and short sides. In this case, too, a desired rectangular cut pattern can be formed with the direction of the blade 40*a* matching the transfer direction.

When the blade 40*a* is located below the workpiece cloth CL held on the embroidery frame 16, the control device 80 controls the cutting needle rotating mechanism 67 based on the detection signal of the vertical position detection unit, so that the cutting needle 40 is rotated. According to this, the cutting needle 40 is prevented from being rotated while in contact with the workpiece cloth CL, with the result that fine cuts can be formed in the workpiece cloth CL.

The cutting needle up-and-down motion mechanism 66 includes the first motor 55, the cam rotated by the drive of the first motor 55, the swing link 60 having the first end brought into contact with the cam surface of the cam and the second end swinging with rotation of the cam, and the cutting needle support 41 which is supported on the machine frame 36 so as to be movable up and down and rotatable and has the connecting part 44 rotatably connected to the second end of the swing link 60 and the mounting cylinder 42 (serving as the mounting part) on which the cutting needle 40 is mounted. According to this, rotation of the cam by the first motor 55 can be converted to the up-and-down motion of the cutting needle support 41 by the swing link 60, with the result that the construction of the cutting needle up-and-down motion mechanism 66 can be simplified.

The cutting needle rotating mechanism 67 includes the second motor 70, the first gear 72*a* (serving as a first rotating member) rotated by the drive of the second motor 70 and the second gear 48 (serving as a second rotating member) provided to be rotated together with the cutting needle support 41 and brought into mesh engagement with the first gear 72*a*. According to this, the cutting needle 40 can be rotated by the second motor 70 via the first and second gears 72*a* and 48, with the result that the construction of the cutting needle rotating mechanism 67 can be simplified.

Figure 11:
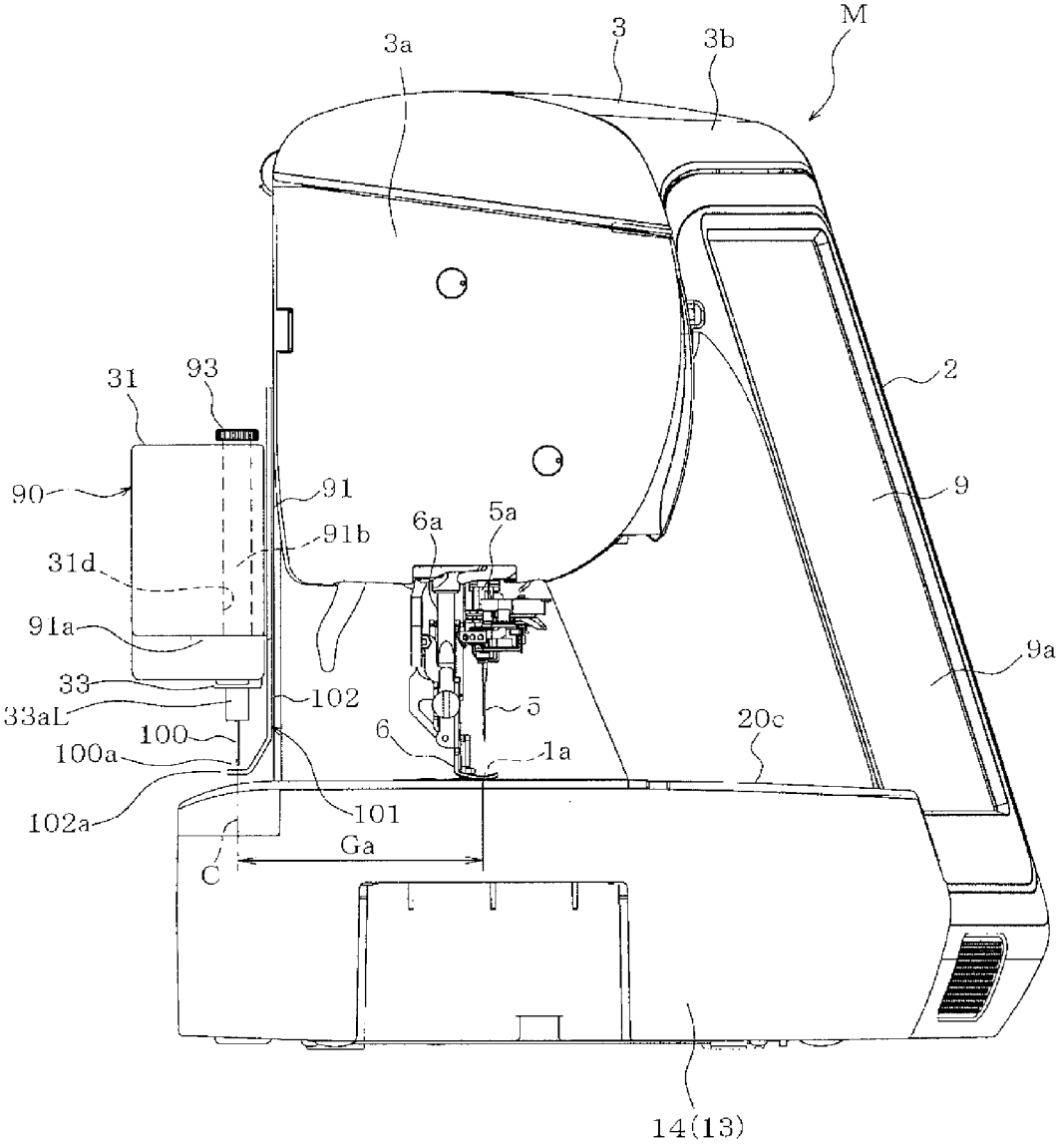
FIG. 11 is a left side elevation of the sewing machine according to a second embodiment together with a cutting unit provided on a sewing machine head.

FIG. 11 illustrates a second embodiment. Only the differences between the first and second embodiments will be described. Identical or similar parts in the second embodiment will be labeled by the same reference symbols as those in the first embodiment.

The cutting unit 90 is mounted on the rear of the head 3*a* in the sewing machine M of the second embodiment. Accordingly, the housing part 21 is eliminated in the embroidery frame transfer device 13. The moving portion 15 of the embroidery frame transfer device 13 is not shown in the drawings. More specifically, a mounting plate 91 (a receiving part) is mounted on the rear of the head 3*a*. The mounting plate 91 is formed into an L-shape in a side view as shown in FIG. 11. The mounting plate 91 includes a left horizontal part 91*a* extending rearward from a left lower end thereof and a right horizontal part (not shown) extending rearward from a right lower end thereof. The stepped portion 31*a* of the enclosure 31 is abuttable on the left horizontal part 91*a*, and the stepped portion 31*b* is abuttable on the right horizontal part. The left horizontal part 91*a* is formed with a boss 91*b*, and the right horizontal part is also formed with a boss (not shown). The bosses are formed into a columnar shape and extend upward. The bosses have upper ends formed with vertically extending screw holes (not shown) respectively.

The stepped portions 31*a* and 31*b* have through holes 31*c* and 31*d* through which the bosses pass vertically, respectively. The holes 31*c* and 31*d* have inner diameters slightly larger than outer diameters of the bosses respectively. The bosses 91*b* are inserted through the respective holes 31*c* and 31*d* while the blade 100*a* of the cutting needle 100 is in a downward direction. In this case, the bosses 91*b* are fitted in the respective holes 31*c* and 31*d* almost without backlash. Screws 93 are threadingly engaged with the screw holes of the bosses 91*b* respectively while the stepped portion 31*a* abuts on the left horizontal portion 91*a* and the stepped portion 31*b* abuts on the right horizontal portion. As a result, the cutting unit 90 is detachably fixed (attached) to the mounting plate 91 of the head 3*a*.

The upper surface 20*c* of the embroidery frame transfer device 13 is formed with a needle hole through which the cutting needle 100 of the cutting unit 90 passes, although the needle hole is not shown. A location of the needle hole or a cut location where a cut is formed by the blade 100*a* of the cutting needle 100 is away by a predetermined distance Ga rearward from the needle location 1*a* of the sewing needle 5. Accordingly, the cut location data in the second embodiment is set to a value obtained by offset with respect to the Y coordinate data by the predetermined distance Ga.

The cutting needle 100 in the second embodiment is set to be longer in the direction of the central axis line C than the cutting needle 40 in the first embodiment. Further, the smaller diameter portion 33*a* in the enclosure 31 (the needle case 33) is also formed to be longer than the smaller diameter portion 33*a*. The cutting needle 100 is moved reciprocally between a lower dead center and an upper dead center. When the cutting needle 100 is located at the lower dead center, the blade 100*a* takes a position below the workpiece cloth CL (or the needle hole) held on the embroidery frame 16. When the cutting needle 100 is located at the upper dead center, the blade 100*a* takes a position above the workpiece cloth CL.

The sewing machine M is further provided with a pressing device 101. The pressing device 101 presses the workpiece cloth CL held on the embroidery frame 16, at a position near the cut location. The pressing device 101 includes a pressing member 102 and a presser foot up-and-down motion mechanism (not shown). The pressing member 102 is formed into the shape of a vertically extending elongate plate, as shown in FIG. 11. The presser foot up-and-down motion mechanism moves the pressing member 102 up and down. The pressing member 102 has a lower end formed with a presser foot 102*a* bent rearward. The presser foot 102*a* has a through hole (not shown) through which the cutting needle 100 passes. The pressing member 102 is configured to be moved up and down along the central axis line C of the cutting needle 100 relative the mounting plate 91. The presser foot up-and-down motion mechanism has a lever (not shown) which is mounted on the mounting plate so as to be operable by the user. The presser foot up-and-down motion mechanism vertically moves the presser foot 102*a* between a pressing position and a retreat position. When located at the pressing position, the presser foot 102*a* presses the workpiece cloth CL. When located at the retreat position, the presser foot 102*a* is spaced from the workpiece cloth CL.

On the occasion of start of the cutting operation, the user operates the lever of the presser foot up-and-down motion mechanism to move the pressing member 102 to the pressing position. Apart of the workpiece cloth CL near the cut location is pressed by the presser foot 102*a* located at the pressing position. In the cutting operation, the control device 80 drives the cutting needle up-and-down mechanism 66 to move the cutting needle 40 reciprocally vertically. At this time, the blade 100*a* of the cutting needle 100 is caused to penetrate the workpiece cloth CL from the upper side to the lower side. Further, based on detection signals of the up-down position sensors 59*a* and 59*b*, the control device 80 moves the embroidery frame 16 and drives the cutting needle rotating mechanism 67 to rotate the cutting needle 100 when the blade 100*a* is located above the workpiece cloth CL. Further, since the part of the workpiece cloth CL located near the cut location is pressed by the presser foot 102*a* during the cutting operation, a fine cut pattern can be formed. Upon completion of the cutting operation, the user operates the lever of the presser foot up-and-down motion mechanism to move the pressing member 102 to the retreat position, releasing the workpiece cloth CL.

In the cutting unit 90 in the above-described second embodiment, the enclosure 31 may be eliminated, and the cutting needle up-and-down motion mechanism 66 and the cutting needle rotating mechanism 67 may directly be mounted on the head 3*a*. In this case, the cutting unit is incorporated in the head 3*a* with the blade 100*a* of the cutting needle 100 being in a downward direction. Thus, the cutting unit is attached to or incorporated in the head 3*a* with the blade 100*a* being in the downward direction. Consequently, both the cutting and the sewing of the workpiece cloth CL can be carried out in the sewing machine M. The second embodiment can thus achieve the same advantageous effect as the first embodiment.

The foregoing embodiments should not be restrictive but can be modified or expanded as follows. The cutting unit 30 should not be limited to the use with the household sewing machine M but can be applied to various types of sewing machines provided with respective sewing machine beds. Further, although the cutting unit 30 is attached to the embroidery frame transfer device 13 in the foregoing embodiment, the housing part to which the cutting unit 30 is detachably attached may be provided in the bed part 1. Further, the enclosure 31 may be eliminated in the cutting unit, and the cutting needle up-and-down motion mechanism 66 and the cutting needle rotating mechanism 67 may be assembled directly to the machine frame in the bed part 1, that is, may be incorporated in the bed part 1.

Further, an auxiliary table (not shown) may be attached to the bed part 1, instead of the embroidery frame transfer device 13. The auxiliary table 90 is an attachment with a known construction to enlarge a surface on which the workpiece cloth CL is placed. The auxiliary table is provided with a fitting part having the same configuration as the fitting part 20*a* of the embroidery frame transfer device 13 although the fitting part is not shown. The fitting part is fitted with the free arm bed so that the auxiliary table is attached to the bed part 1. In the state where the auxiliary table is attached to the bed part 1, the upper surface of the auxiliary table is substantially co-planar with the top of the bed part 1 thereby to serve as a surface on which the workpiece cloth CL is placed. A housing part is provided in the auxiliary table to detachably house the cutting unit 30. The housing part may have the same configuration as the housing part 21 of the embroidery frame transfer device 13. Alternatively, the cutting needle up-and-down motion mechanism 66 and the cutting needle rotating mechanism 67 may be assembled directly to the machine frame in the auxiliary table. This construction also allows the cutting unit to be provided with the blade 40*a* being in an upward direction, so that the same effect as the foregoing embodiments can be achieved.

The housing part should not be limited to the recess (the housing part 21) which is formed in the embroidery frame transfer device 13 so as to be open downward. More specifically, the housing part formed in the embroidery frame transfer device may be open upward so that the cutting unit is attached thereto from above or may be open in a side (open in the peripheral wall side) so that the cutting unit is attached thereto from the side. The housing part thus formed may be provided as a recess in the sewing machine bed or the auxiliary table. Further, the location of the cutting unit should not be limited to the rearward of the needle location 1*a* but may be any location other than the rearward of the needle location 1*a*, for example, at a position spaced from the needle location 1*a* in the right-left direction.

The cutting needle rotating mechanism 67 should not be limited to the above-described construction. For example, the driving gear 70*a* serving as the first gear may be brought into direct mesh engagement with the second gear 48 of the cutting needle support 41. Further, a separate cam may be provided, instead of the grooved cam 57*a* of the driven gear 57, and an outer periphery of the cam may serve as a cam surface. Additionally, the shape of the blade 40*a* may be changed. Thus, various changes may be made in the sewing machine M or the embroidery frame transfer device 13.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

We claim:

1. A sewing machine comprising:

a needle bar to which a sewing needle is attached;

a needle bar up-and-down motion mechanism moving the needle bar up and down;

a sewing machine motor configured to generate drive power to drive the needle bar up-and-down motion mechanism so that the needle bar is moved up and down; and a cutting unit including:

a cutting needle having a distal end formed with a blade;

a cutting needle up-and-down motion mechanism having a first motor which is separate from the sewing machine motor and which is configured to generate drive power to move the cutting needle up and down independently of the needle bar up-and-down motion mechanism, so that a cut is formed by the blade as a result of the up-and-down motion of the cutting needle while the cutting needle is held in a manner such that an extending direction of the cutting needle corresponds with an extending direction of the needle bar; and a cutting needle rotating mechanism configured to rotate the cutting needle about a central axis line of the cutting needle directed to the extending direction of the needle bar and the cutting needle.

2. The sewing machine according to claim 1, wherein the cutting unit is provided on a sewing machine bed with the blade being directed upward.

3. The sewing machine according to claim 2, wherein the sewing machine bed includes an attachment detachably attachable to a bed part of the sewing machine.

4. The sewing machine according to claim 3, wherein the attachment is an embroidery frame transfer device which is configured to transfer an embroidery frame in two predetermined directions.

5. The sewing machine according to claim 4, wherein the embroidery frame transfer device is provided with a housing part into which the cutting unit is detachably housed.

6. The sewing machine according to claim 5, wherein the housing part is a recess formed in the embroidery frame transfer device so as to be open downward.

7. The sewing machine according to claim 1, wherein the cutting unit is provided on a sewing machine head with the blade being directed downward.

8. The sewing machine according to claim 1, wherein the cutting unit includes an enclosure which is configured to cover the cutting needle and the cutting needle up-and-down motion mechanism, and the enclosure has a hole through which the blade appears or disappears with an up-and-down motion of the cutting needle.

9. The sewing machine according to claim 4, further comprising a control device configured to control the cutting needle rotating mechanism so that the cutting needle is rotated depending upon a transfer direction of the embroidery frame based on cutting data including transfer data for transferring the embroidery frame.

10. The sewing machine according to claim 9, wherein:

the cutting unit includes an up-down position detection unit configured to detect an up-down position of the cutting needle; and the control device is further configured to control the cutting needle rotating mechanism based on a detection signal of the up-down position detection unit.

11. The sewing machine according to claim 1, wherein the cutting needle up-and-down motion mechanism further includes:

a cam configured to be rotated by the first motor;

a swing link having a first end brought into contact with a cam surface of the cam and a second end configured to be swung with rotation of the cam; and a cutting needle support supported on a machine frame so as to be movable up and down and rotatable, the cutting needle support having a connecting part rotatably connected to the second end of the swing link and a mounting portion on which the cutting needle is mounted.

12. The sewing machine according to claim 11, wherein the cutting needle rotating mechanism further includes:

a second motor;

a first rotating member configured to be rotated by drive of the second motor; and a second rotating member configured to be rotated together with the cutting needle support, the second rotating member being rotated by rotation of the first rotating member.

13. The sewing machine according to claim 9, wherein:

the transfer data defines a cut position for every up-and-down motion of the cutting needle, and the cutting data includes angle data which is indicative of a rotation angle about the central axis line and which is set to correspond to every cut position; and the control device executes a process of controlling the cutting needle rotating mechanism so that a cut is formed by the blade at every cut position at the rotation angle about the central axis line corresponding to the cut position, based on the angle data.

* * * * *